US010538830B2

(12) United States Patent
Fukumoto et al.

(10) Patent No.: US 10,538,830 B2
(45) Date of Patent: Jan. 21, 2020

(54) STEEL SHEET AND METHOD OF PRODUCING THE SAME

(71) Applicant: NIPPON STEEL CORPORATION, Tokyo (JP)

(72) Inventors: Yuji Fukumoto, Tokyo (JP); Takashi Aramaki, Tokyo (JP); Junichi Yasui, Tokyo (JP); Norimitsu Harada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 1428 days.

(21) Appl. No.: 14/349,038

(22) PCT Filed: Oct. 5, 2012

(86) PCT No.: PCT/JP2012/076025
§ 371 (c)(1),
(2) Date: Apr. 1, 2014

(87) PCT Pub. No.: WO2013/051714
PCT Pub. Date: Apr. 11, 2013

(65) Prior Publication Data

US 2014/0230973 A1 Aug. 21, 2014

(30) Foreign Application Priority Data

Oct. 6, 2011 (JP) ..... 2011-221904

(51) Int. Cl.
*C22C 38/12* (2006.01)
*C22C 38/22* (2006.01)
(Continued)

(52) U.S. Cl.
CPC ..... *C22C 38/12* (2013.01); *C21D 9/46* (2013.01); *C21D 9/56* (2013.01); *C21D 9/573* (2013.01);
(Continued)

(58) Field of Classification Search
CPC ..... C22C 38/00; C22C 38/02; C22C 38/04; C22C 38/06; C22C 38/12; C22C 38/14;
(Continued)

(56) References Cited

U.S. PATENT DOCUMENTS

2004/0099349 A1* 5/2004 Hoydick ..... C21D 1/20 148/533
2008/0000555 A1 1/2008 Nonaka et al.
2009/0223607 A1 9/2009 Hasegawa et al.

FOREIGN PATENT DOCUMENTS

CN 1648277 A 8/2005
CN 101035921 A 9/2007
(Continued)

OTHER PUBLICATIONS

Taiwanese Office Action dated Mar. 19, 2014, issued in Taiwanese Patent Application No. 101137088.
(Continued)

*Primary Examiner* — Alexandra M Moore
(74) *Attorney, Agent, or Firm* — Birch, Stewart, Kolasch & Birch, LLP

(57) ABSTRACT

A steel sheet of the present invention has a steel structure obtained by performing a soaking at a dual phase region temperature of Ac1 temperature or higher and lower than Ac3 temperature for a soaking time of 15 seconds or longer and 35 seconds or shorter, next, performing a primary cooling to a temperature range of 250° C. or higher and 380° C. or lower within 3 seconds at a cooling rate of 0.5° C./s or more and 30° C./s or less, and performing a retention in a temperature range of 260° C. or higher and 370° C. or lower for 180 seconds or longer and 540 seconds or shorter, in which a yield ratio is 65% or less and tensile strength is 590 MPa or more after the primary cooling.

11 Claims, 2 Drawing Sheets

(51) Int. Cl.

| | |
|---|---|
| ***C22C 38/24*** | (2006.01) |
| ***C22C 38/18*** | (2006.01) |
| ***C22C 38/32*** | (2006.01) |
| ***C21D 9/46*** | (2006.01) |
| ***C21D 9/56*** | (2006.01) |
| ***C22C 38/06*** | (2006.01) |
| ***C22C 38/38*** | (2006.01) |
| ***C22C 38/00*** | (2006.01) |
| ***C22C 38/02*** | (2006.01) |
| ***C22C 38/04*** | (2006.01) |
| ***C21D 9/573*** | (2006.01) |
| ***C22C 38/14*** | (2006.01) |
| ***C22C 38/26*** | (2006.01) |
| ***C22C 38/28*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C22C 38/18; C22C 38/22; C22C 38/24; C22C 38/26; C22C 38/28; C22C 38/32; C22C 38/38; C21D 2211/002; C21D 2211/008; C21D 9/46; C21D 9/56; C21D 9/573; C21D 2211/001; C21D 2211/005
See application file for complete search history.

(56) References Cited

FOREIGN PATENT DOCUMENTS

| | | | |
|---|---|---|---|
| JP | 9-287050 | A | 11/1997 |
| JP | 10-147838 | A | 6/1998 |
| JP | 11-293396 | A | 10/1999 |
| JP | 11-350063 | A | 12/1999 |
| JP | 2000-178644 | A | 6/2000 |
| JP | 2001-335890 | A | 12/2001 |
| JP | 2002-226937 | A | 8/2002 |
| JP | 2003-213370 | A | 7/2003 |
| JP | 2006-283071 | A | 10/2006 |
| JP | 2007-39749 | A | 2/2007 |
| JP | 2007-56294 | A | 3/2007 |
| JP | 2008-190032 | A | 8/2008 |
| TW | 200530409 | | 9/2005 |

OTHER PUBLICATIONS

International Search Report issued in PCT/JP2012/076025, dated Jan. 8, 2013.
Chinese Office Action and Search Report, dated May 28, 2015, for Application No. 201280048725.7, with an English translation.

* cited by examiner

STEEL SHEET AND METHOD OF PRODUCING THE SAME

TECHNICAL FIELD OF THE INVENTION

The present invention relates to a high strength steel sheet which has a low yield ratio and excellent elongation, and a method of producing the same.

Priority is claimed on Japanese Patent Application No. 2011-221904, filed on Oct. 6, 2011, and the content of which are incorporated herein by reference.

RELATED ART

In recent years, there has been an increasing demand for weight saving of vehicle bodies to improve fuel consumption and for improving collision safety to protect the passengers at the time of collision in automobiles or the like. Therefore, the use of high strength steel sheets has increased but excellent workability (ductility and the like) that is necessary for the formation of vehicle bodies and parts is required for high strength steel sheets used in automobiles or the like, as well as required strength.

As one of the indices for evaluating the workability of high strength steel sheets, there is a yield ratio (a ratio of yield strength (YP) to tensile strength (TS): YP/TS×100 (%)). Usually, when a yield ratio decreases, deterioration in shape fixability which tends to deteriorate along with strengthening and the occurrence of wrinkles can be suppressed. In addition, it is possible to reduce a press load.

As a high strength steel sheet supplied for an application in which satisfactory elongation (ductility) is needed, there has been known dual phase steel (hereinafter, referred to as "DP steel" in some cases) having a dual phase structure of ferrite and martensite, and the steel has been widely used for structural members for automobiles. The DP steel has an excellent balance of strength and ductility compared to a solute strengthening type steel sheet and a precipitation strengthening type steel sheet, and also has a feature of a low yield ratio (for example, refer to Patent Documents 1 to 6).

In Patent Document 1, a technique is disclosed in which a dual phase structure of ferrite and martensite is formed by holding steel in a temperature range of Ac1 or higher and Ac1+75° C. or lower for 15 seconds or longer, and then, cooling the steel to a temperature of 200° C. or lower at a cooling rate of 10° C./s or more.

In Patent Document 2, a technique is disclosed in which a dual phase structure of ferrite and martensite is formed by cooling steel to 700° C. to 600° C. from an annealing soaking temperature at 15° C./s or less, subsequently, cooling to room temperature at 100° C./s or more, and reheating the steel to hold the steel at 150° C. to 250° C.

In Patent Document 3, a technique is disclosed in which an amount of solid-soluted C and martensite hardness in steel is adjusted while the steel has a dual phase structure of ferrite and martensite formed by cooling the steel to a Ms point or lower from a dual phase region temperature (preferably 20° C./s or more) and transforming austenite to martensite, and then, holding the steel in a temperature range of 100° C. to 250° C. for 10 seconds or longer.

In Patent Document 4, a technique is disclosed in which a dual phase structure of ferrite and martensite is formed by holding to anneal steel at a dual phase region temperature of Ac1 point or higher and lower than Ac3 for 30 seconds to 90 seconds, and then, cooling the steel to 550° C. at 5° C./s or more.

In Patent Document 5, a technique is disclosed in which a dual phase structure of ferrite and martensite is formed by annealing a cold-rolled steel sheet at a required temperature, and then cooling the steel sheet at a cooling rate of 10° C./s or more, preferably 20° C./s or more.

In Patent Document 6, a technique is disclosed in which a dual phase structure of ferrite and martensite is formed by annealing a cold-rolled steel sheet at a required temperature for 3 seconds or longer, and then cooling the steel sheet to lower than 400° C. at a cooling rate of 2° C./s to 200° C./s.

As disclosed in Patent Documents 1 to 6 above, it is known that it is important to control a cooling rate and a cooling end temperature after annealing in a dual phase region to obtain a dual phase structure (DP steel) which satisfies required mechanical properties.

PRIOR ART DOCUMENT

Patent Document

[Patent Document 1] Japanese Unexamined Patent Application, First Publication No. H09-287050

[Patent Document 2] Japanese Unexamined Patent Application, First Publication No. H10-147838

[Patent Document 3] Japanese Unexamined Patent Application, First Publication No. H11-350063

[Patent Document 4] Japanese Unexamined Patent Application, First Publication No. 2001-335890

[Patent Document 5] Japanese Unexamined Patent Application, First Publication No. 2002-226937

[Patent Document 6] Japanese Unexamined Patent Application, First Publication No. 2003-213370

DISCLOSURE OF THE INVENTION

Problems to be Solved by the Invention

However, in the manufacturing methods in Patent Documents 1 to 6, in order to produce a steel sheet having a dual phase structure of ferrite and martensite, a rapid cooling apparatus and a large amount of Mn that improves hardenability are used. Therefore, there is a problem in that workability is deteriorated caused by local material deterioration due to component segregation.

Usually, when steel is not cooled at a rapid cooling rate after being soaked in a dual phase region, pearlite is precipitated from a hardened structure such as martensite, bainite, or the like, and thus, it is difficult to ensure the required strength. In addition, when a steel sheet is annealed and cooled in a continuous annealing furnace having a usual overaging section, the cooling end temperature is held around 400° C., and thus, formed martensite is tempered and decomposed into pearlite.

In a case where a large amount of an austenite former (Mn is generally used) is used so that steel is easily transformed, when a cooling rate after annealing is not optimized, workability is deteriorated due to component segregation and also, deterioration in ductility (elongation) is caused by martensite in a Mn segregated portion.

As described above, in order to obtain a dual phase structure which shows a low yield ratio and excellent elongation, it is important to control the cooling rate and the cooling end temperature after annealing in the dual phase region, but it is difficult to stably obtain a high strength steel which shows a low yield ratio and excellent elongation only by cooling after annealing.

The present invention is made in consideration of the above circumstances and an object thereof is to provide a high strength steel sheet which has a structure showing a low yield ratio and excellent elongation and a method of producing the same. In the present invention, the low yield ratio refers to a yield ratio of 65% or less, and the high strength refers to a tensile strength of 590 MPa or more.

In addition, when it is considered that the steel sheet is used as a member for automobiles or the like, TS×El, which is a product of tensile strength TS and elongation El, is preferably 17500 (MPa·%) or more in terms of workability.

Means for Solving the Problem

The inventors have conducted intensive studies of a method for solving the above problem. As a result, it has been found that it is effective to strictly manage a cooling rate and a cooling end temperature after annealing in a dual phase region and further, to perform retention in the optimum temperature range after performing the cooling. That is, the inventors have found the following. Here, the retention may denote not only isothermal holding but also a temperature change in the temperature range.

(i) It is possible to form a steel sheet which mainly includes ferrite and martensite as a structure (a so-called dual phase structure) by decreasing the cooling rate of a steel sheet after annealing (a primary cooling rate) and making a cooling end temperature fall within a required temperature range. Therefore, it is effective to produce a steel sheet of 590 MPa or more having a low yield ratio and excellent elongation.

(ii) However, when the primary cooling rate is slow, since martensite is difficult to be formed it is difficult to obtain the dual phase structure. On the other hand, when the amount of Mn is increased so as to form martensite, Mn is segregated and thus, deterioration in ductility is caused by the martensite in a Mn segregated portion and a yield point increases. On the contrary, even when a large amount of Mn is contained, if a soaking time in annealing is increased, Mn is uniformly diffused and the segregation is eliminated. Therefore, the martensite is uniformly formed in a thickness direction and a width direction and the quality of the material becomes uniform.

(iii) Further, by performing soaking and retention in which a retention time and a retention temperature after primary cooling are controlled, it is possible to obtain a structure suitable for a steel sheet of 590 MPa or more which has a low yield ratio and excellent elongation.

The present invention is made based on the above findings and the gist thereof is as follows.

(1) According to an aspect of the present invention, there is provided a steel sheet including, by mass %, C: 0.04% or more and 0.15% or less, Si: 0.3% or more and 0.7% or less, Mn: 1.0% or more and 3.0% or less, Al: 0.005% or more and 0.10% or less, P: limited to 0.03% or less, S: limited to 0.01% or less; N: limited to 0.01% or less, and a remainder consisting of Fe and unavoidable impurities, wherein the steel sheet has a steel structure obtained by performing a soaking for a soaking time of 15 seconds or longer and 35 seconds or shorter at a dual phase region temperature of Ac1 temperature or higher and lower than Ac3 temperature, next, performing a primary cooling to a temperature range of 250° C. or higher and 380° C. or lower at a cooling rate of 0.5° C./s or more and 30° C./s or less within 3 seconds, and performing a retention in a temperature range of 260° C. or higher and 370° C. or lower for 180 seconds or longer and 540 seconds or shorter after the primary cooling, a yield ratio is 65% or less and tensile strength is 590 MPa or more, and the Ac1 temperature is a temperature expressed by a following Expression (a) in units of ° C., and the Ac3 temperature is a temperature expressed by a following Expression (b) in units of ° C.

$$Ac1=732-26.6\times[C]+17.6\times[Si]-11.6\times[Mn] \quad (a)$$

$$Ac3=924+56.1\times[Si]-19.7\times[Mn]-436.5\times[C] \quad (b)$$

here, [C], [Si], and [Mn] represent a C content, an Si content, and an Mn content respectively, and a unit thereof is mass %.

(2) In the steel sheet according to (1), the cooling rate may be 0.5° C./s or more and 15° C./s or less.

(3) In the steel sheet according to (1) and (2), y which is a product of a retention temperature and a retention time in the retention and x which is the cooling rate in the primary cooling may satisfy a following Expression (c).

$$y\leq 796700\times x^{(-0.971)} \quad (c).$$

(4) The steel sheet according to any one of (1) to (3), may further include, by mass %, any one or two or more of Cr: 0.01% or more and 0.5% or less, Mo: 0.01% or more and 0.5% or less, and B: 0.0005% or more and 0.005% or less, and the Ac1 temperature may a temperature expressed by a following Expression (d) in units of ° C., and the Ac3 temperature may be a temperature expressed by a following Expression (e) in units of ° C.

$$Ac1=732-26.6\times[C]+17.6\times[Si]-11.6\times[Mn]+24.1\times[Cr] \quad (d)$$

$$Ac3=924+56.1\times[Si]-19.7\times[Mn]-4.9\times[Cr]-436.5\times[C] \quad (e)$$

here, [C], [Si], [Mn], and [Cr] represent a C content, an Si content, an Mn content, and a Cr content respectively, and a unit thereof is mass %.

(5) The steel sheet according to (4), may further include, by mass %, one or two or more of Nb, Ti, and V of 0.005% or more and 0.05% or less in total.

(6) The steel sheet according to any one of (1) to (3), may further include, by mass %, one or two or more of Nb, Ti, and V of 0.005% or more and 0.05% or less in total.

(7) In the steel sheet according any one of (1) to (3), the steel structure may be a structure that contains, by an area fraction, a bainite and a martensite in a total of 3% or more and 10% or less, a residual austenite of 1% or more and 3% or less, and a remainder consisting of a ferrite.

(8) In the steel sheet according to (7), in the steel structure, by an area fraction, the bainite may be limited to 1% or less.

(9) According to another aspect of the present invention, a method is provided in which a steel sheet is produced using a continuous annealing line, the method including a first retention process of retaining a base steel sheet having the component composition according to (1) at a dual phase region temperature of Ac1 temperature or higher and lower than Ac3 temperature for 15 seconds or longer and 35 seconds or shorter; a primary cooling process of primarily cooling the steel sheet to a temperature range of 250° C. or higher and 380° C. or lower within 3 seconds at a cooling rate of 0.5° C./s or more and 30° C./s or less after the first retention process; and a second retention process of retaining the steel sheet while passing through an overaging section arranged in the continuous annealing line whose temperature is set to 260° C. or higher and 370° C. or lower for a retention time of 180 seconds or longer and 540 seconds or shorter after the primary cooling.

(10) In the method of producing a steel sheet according to (9), in the second retention process, y that is a product of an overaging section passing temperature which is the retention temperature when the steel sheet passes through the overaging section, and an overaging section passing time which is the retention time, and x that is the cooling rate in the primary cooling process may satisfy a following Expression (f).

$$y \leq 796700 \times x^{(-0.971)} \quad (f)$$

(11) The method of producing a steel sheet according to (9) or (10), may further include a preliminary sheet passing process of, before starting the primary cooling process, passing a required amount or more of a temperature adjusted steel sheet whose primary cooling stop temperature is set to 330° C. or lower through the continuous annealing line.

(12) In the method of producing a steel sheet according to (11), the required amount may 30 tons.

(13) In the method of producing a steel sheet according to (9) or (10), the base steel sheet may further contain, by mass %, any one or two or more of Cr: 0.01% or more and 0.5% or less, Mo: 0.01% or more and 0.5% or less, and B: 0.0005% or more and 0.005% or less.

(14) In the method of producing a steel sheet according to (13), the base steel sheet may further contain, by mass %, one or two or more of Nb, Ti, and V of 0.005% or more and 0.05% or less in total.

(15) In the method of producing a steel sheet according to (9) or (10), the base steel sheet may further contain, by mass %, one or two or more of Nb, Ti, and V of 0.005% or more and 0.05% or less in total.

Effect of the Invention

According to the present invention, it is possible to provide a high strength steel sheet which is suitable for vehicle bodies and parts for automobiles and has a low yield ratio and excellent elongation.

EMBODIMENTS OF THE INVENTION

Figure 1:
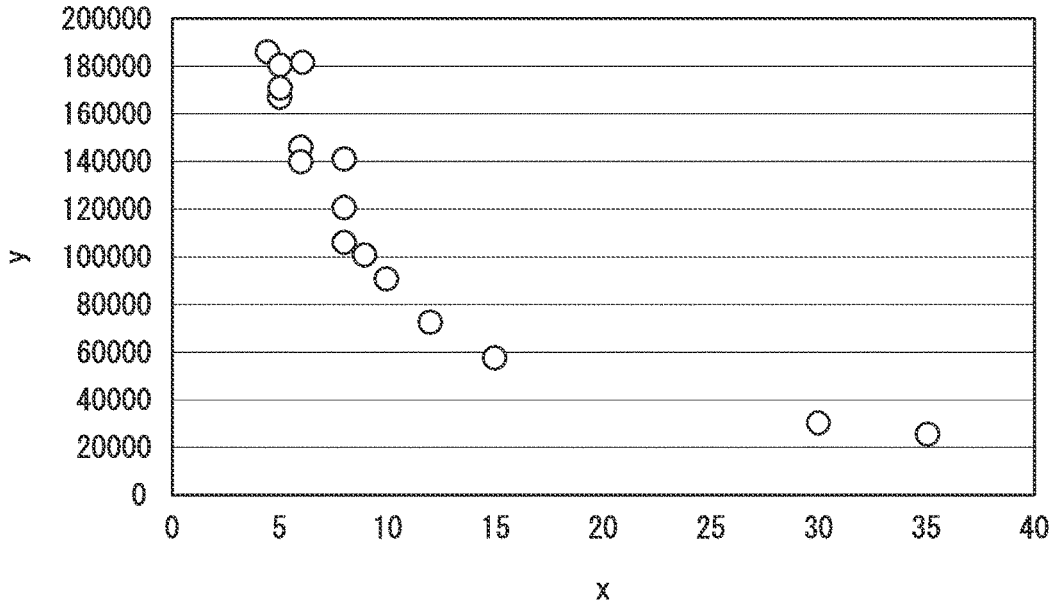
FIG. 1 is a view showing a relationship between y which is a product of a retention temperature and a retention time at the time of retention in a temperature range of 260° C. or higher and 370° C. or lower (at the time of passage through an overaging section) and x which is a primary cooling rate.
Figure 2:
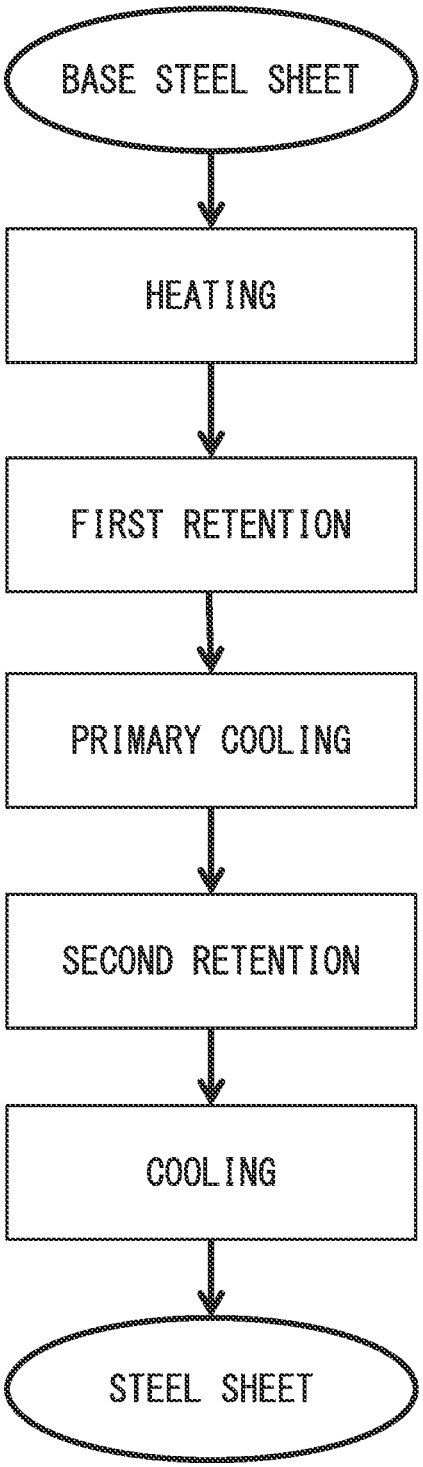
FIG. 2 is a flow chart showing a method of producing a steel sheet according to an embodiment of the present invention.

Hereinafter, an embodiment of the present invention will be described based on the above findings.

A high strength steel sheet according to the embodiment which has a low yield ratio and excellent elongation (hereinafter, referred to as a "steel sheet according to the embodiment" in some cases) includes, by mass %, C: 0.04% or more and 0.15% or less, Si: 0.3% or more and 0.7% or less, Mn: 1.0% or more and 3.0% or less, Al: 0.005% or more and 0.10% or less, P: limited to 0.03% or less, S: limited to 0.01% or less, N: limited to 0.01% or less, and a remainder consisting of Fe and unavoidable impurities, and has a steel structure obtained by performing soaking for a soaking time of 15 seconds or longer and 35 seconds or shorter at a dual phase region temperature of Ac1 temperature or higher and lower than Ac3 temperature, next, performing primary cooling to a temperature range of 250° C. or higher and 380° C. or lower at a cooling rate of 0.5° C./s or more and 30° C./s or less within 3 seconds, and performing retention in a temperature range of 260° C. or higher and 370° C. or lower for 180 seconds or longer and 540 seconds or shorter after the primary cooling.

First, the reason for limiting the component composition in the steel sheet according to the embodiment will be described. Here, % related to the component composition represents mass %.

C: 0.04% or More and 0.15% or Less

C is an element effective to contribute to the formation of bainite and martensite to achieve a low yield ratio and high strength. When the C content is less than 0.04%, the effect cannot be obtained, and thus, the lower limit is set to 0.04%. On the other hand, when the C content exceeds 0.15%, bainite and martensite are excessively formed, and thus, the upper limit is set to 0.15%. In addition, when the C content is high, weldability is deteriorated and a problem arises in practical use. The C content is preferably 0.07% or more and 0.12% or less.

Si: 0.3% or More and 0.7% or Less

Si is an element effective to increase mechanical strength (TS) without deterioration in ductility. However, when the Si content is less than 0.3%, the addition effect is not exhibited sufficiently and thus, the lower limit of the content is set to 0.3%. On the other hand, when the content exceeds 0.7%, ductility is deteriorated and thus, the upper limit is set to 0.7%. In addition, when the Si content exceeds 0.7%, there is a concern of excessive formation of residual austenite. The Si content is preferably 0.4% or more and 0.6% or less.

Mn: 1.0% or More 3.0% or Less

Mn is an element which stabilizes austenite and contributes to uniform formation of martensite and improvement of ductility even when the cooling rate is slow. However, when the Mn content is less than 1.0%, the addition effect is not exhibited sufficiently, and thus, the lower limit is set to 1.0%.

On the other hand, when the Mn content exceeds 3.0%, Mn is segregated. The martensite formed in the segregated portion causes deterioration in ductility and deterioration in workability due to an increase of a yield point. In addition, when the Mn content exceeds 3.0%, martensite is excessively formed and ductility is deteriorated. Therefore, the upper limit of the Mn content is set to 3.0%. The upper limit is preferably 2.6% or less.

P: 0.03% or Less

P is an impurity element and thus, the lower the content is, the more preferable it is. However, up to 0.03%, mechanical properties are not impaired, and thus, the upper limit of the P content is set to 0.03%. The upper limit is preferably 0.01% or less. Here, it is difficult to set the P content to 0% in operation, and thus, 0% is not included.

S: 0.01% or Less

S is an impurity element and thus, the lower the content is, the more preferable it is. However, up to 0.01%, mechanical properties are not impaired, and thus, the upper limit of the S content is set to 0.01%. The upper limit is preferably 0.005% or less. Here, it is difficult to set the S content to 0% in operation, and thus, 0% is not included.

Al: 0.005% or More and 0.10% or Less

Al is an element which is usually used for deoxidation, but, similar to Mn, is an element which contributes to improvement in hardenability. However, when the Al content is less than 0.005%, deoxidation is not sufficient and ductility is deteriorated. Thus, the lower limit is set to 0.005%. In addition, when the Al content is less than 0.005%, hardenability is deteriorated and tensile strength is deteriorated. Therefore, there is a concern of increasing a yield ratio. On the other hand, when the Al content exceeds 0.10%, the addition effect is saturated and thus, the upper limit is set to 0.10%. The Al content is preferably 0.01% or more and 0.06% or less.

N: 0.01% or Less

N is an element which contributes to the formation of martensite, similar to C. However, when Al as the deoxidizing element is present, Al nitrides are formed and ductility is deteriorated. Thus, the N content is set to 0.01% or less. The lower the N content is, the more preferable it is. However, in order to set the N content to less than 0.001%, a denitrification process is required and production cost increases, and thus, the lower limit is preferably set to 0.001%. The content is more preferably 0.001% or more and 0.005% or less.

The steel sheet according to the embodiment may further contain, by mass %, any one or two or more of Cr: 0.01% or more and 0.5% or less, Mo: 0.01% or more and 0.5% or less, and B: 0.0005% or more and 0.005% or less.

Cr: 0.01% or More and 0.5% or Less

Cr is an element which increases the hardenability of steel and contributes to the formation of martensite. However, when the Cr content is less than 0.01%, the addition effect is not sufficient and thus, the lower limit when Cr is added is set to 0.01%. On the other hand, when the content exceeds 0.5%, formability and weldability are deteriorated and thus, the upper limit is set to 0.5%. The content is preferably 0.05% or more and 0.3% or less.

Mo: 0.01% or More and 0.5% or Less

Mo is an element which increases the hardenability of steel and contributes to the formation of martensite, similar to Cr. However, when the Mo content is less than 0.01%, the addition effect is not sufficient and thus, the lower limit when Mo is added is set to 0.01%. On the other hand, when the content exceeds 0.5%, formability and weldability are deteriorated and thus, the upper limit is set to 0.5%. The content is preferably 0.05% or more and 0.3% or less.

B: 0.0005% or More and 0.005% or Less

B is an element which increases the hardenability of steel and contributes to the formation of martensite, similar to Cr and Mo. However, when the B content is less than 0.0005%, the addition effect is not sufficient and thus, the lower limit when B is added is set to 0.0005%. On the other hand, when the content exceeds 0.005%, the amount of ferrite is too small and workability is deteriorated. Thus, the upper limit is set to 0.005%. The content is preferably 0.0008% or more and 0.003% or less.

The steel sheet according to the embodiment may further contain, by mass %, one or two or more of Nb, Ti, and V of 0.005% or more and 0.05% or less, in total.

Nb, Ti and V are elements which form carbonitrides to be precipitated in the steel and contribute to improvement in mechanical properties in the steel sheet. When the total content of one or two or more of Nb, Ti and V is less than 0.005%, the addition effect is hardly obtained and thus, the lower limit when one or two or more of Nb, Ti and V are added is set to 0.005%. On the other hand, when the total content exceeds 0.05%, workability is deteriorated and thus, the upper limit is set to 0.05%. The content is preferably 0.008% or more and 0.03% or less.

The steel sheet according to the embodiment may further contain elements other than the above elements (for example, Cu, Ni, Zr, Sn, Co, As and the like) as unavoidable impurities as long as the properties are not deteriorated.

Next, the metallographic structure (microstructure) of the steel sheet according to the embodiment will be described.

The steel sheet according to the embodiment has a steel structure obtained by soaking a base steel sheet having the above component composition at a dual phase region temperature of Ac1 temperature or higher and lower than Ac3 temperature for a soaking time of 15 seconds or longer and 35 seconds or shorter, next, primarily cooling the steel sheet to a temperature range of 250° C. or higher and 380° C. or lower within 3 seconds at a cooling rate of 0.5° C./s or more and 30° C./s or less, and after the primary cooling, retaining the steel sheet in a temperature range of 260° C. or higher and 370° C. or lower for 180 seconds or longer and 540 seconds or shorter. The steel sheet which has a yield ratio of 65% or less, a tensile strength of 590 MPa, and excellent elongation is obtained by forming the above-described structure.

In the steel sheet according to the embodiment, for example, the steel structure may be a structure that contains, by an area fraction, bainite and martensite in a total of 3% or more and 10% or less, residual austenite of 1% or more and 3% or less, and a remainder consisting of ferrite. In the case of the structure having such area fractions, low yield ratio, high elongation and high strength are easily achieved.

By containing the bainite and martensite in a total of 3% or more, it is possible to obtain a desired high strength. However, when the bainite and martensite are contained more than 10% there is unevenness in the strength of the structure and thereby ductility is locally deteriorated, and thus, more than 10% of the bainite and martensite is not preferable. When the residual austenite is uniformly present, ductility is improved. Since the effect is weak at less than 1% of the residual austenite, the lower limit is preferably 1%. However, the bainite and martensite, and the residual austenite have a competitive relationship, that is, when the area fraction of the residual austenite increases, the area fraction of the bainite and martensite decreases. When the area fraction of the residual austenite exceeds 3%, the area fraction of the bainite and martensite decreases, and the yield ratio is increased by deterioration in the tensile strength. Thus, the area fraction exceeding 3% is not preferable. In addition, the bainite deteriorates a balance between strength and ductility compared to the martensite, the bainite of 1% or less is preferable. In the structure containing pearlite, a sufficient tensile strength to yield strength cannot be obtained, that is, a yield ratio is increased in some cases. In addition, C is suppressed to being concentrated onto non-transformed austenite due to the formation of the pearlite, the formation of the residual austenite is hindered. Therefore, it is preferable not to include pearlite.

The observation and determination of the structure may be performed in such a manner that 1000 grains or more in a sample which is etched using a nital reagent are observed at a magnification of 400 times at three visual fields or more with an optical microscope.

Next, a method of producing a steel sheet according to an embodiment will be described.

First, a base steel sheet having the above component composition is heated to a dual phase region temperature, that is, a temperature of Ac1 temperature or higher and lower than Ac3 temperature, and is soaked at the dual phase region temperature for a soaking time of 15 seconds or longer and 35 seconds or shorter (first retention). When the soaking time is shorter than 15 seconds, the segregation of Mn and the like cannot be uniformized and unevenness is caused in material of the base steel sheet. As a result, since pearlite is formed at a portion in which sufficient segregation is not obtained, a soaking time of shorter than 15 seconds is not preferable.

Here, as the above base steel sheet, a steel sheet that is produced by a known casting method, and hot rolling method can be used.

A substitutional element such as Mn or the like has a low diffusion rate. Therefore, when the cooling rate after soaking is slow, martensite and residual austenite are formed around the Mn segregated portion. Thus, martensite and residual austenite are hardly formed in portions other than the Mn segregated portion and there is a concern that a non-uniform structure may be formed. However, when a sufficient soaking time is given and the substitutional element such as Mn or the like is uniformly diffused as described above, martensite is uniformly formed in the thickness direction and the width direction of the steel sheet and thus, it is possible to suppress local concentration in processing.

When the soaking temperature is lower than Ac1 temperature, the diffusion rate of Mn is slow and Mn is not concentrated, and thus, pearlite is formed at the cooling rate of the embodiment. In addition, when the soaking temperature is Ac3 or higher, C concentration onto austenite (γ) does not proceed in soaking, and thus, pearlite is formed. Therefore, the soaking temperature is set to Ac1 temperature or higher and lower than Ac3 temperature.

By taking a sufficient soaking time, residual austenite is uniformly formed in the structure. The residual austenite contributes to the improvement of ductility.

On the other hand, when the soaking time is too long, an amount of scale is increased and the yield is decreased. Therefore, the soaking time is set to 35 seconds or shorter.

After the soaking, primary cooling to a temperature range of 250° C. or higher and 380° C. or lower at a cooling rate of 0.5° C./s or more and 30° C./s or less, is performed. When it takes a long time before the cooling is started, non-transformed austenite is transformed to ferrite, and thereby bainite and martensite cannot be obtained after cooling in some cases. Therefore, after the soaking is completed, it is preferable that the primary cooling is performed within 3 seconds. The primary cooling is preferably started in a time as short as possible after the soaking, but it is difficult to set the time to be shorter than 1.5 seconds in actual production, and thus, a time shorter than 1.5 seconds is the actual lower limit.

When the cooling rate after the soaking (primary cooling rate) is less than 0.5° C./s, even when the amount of Mn is within the range of the present invention, Mn segregates and the structure is not uniform. In addition, required strength cannot be obtained due to pearlite precipitated from the hardened structure and the like.

On the other hand, when the cooling rate exceeds 30° C./s, since the cooling rate is too fast, martensite is excessively formed and thus, the balance between strength and ductility is deteriorated. Therefore, the cooling rate after the soaking is set to 0.5° C./s or more and 30° C./s or less. The cooling rate is preferably 0.5° C./s or more and 15° C./s or less.

In the cooling after the soaking, in addition to the cooling rate of 0.5° C./s or more and 30° C./s or less, it is important to make a cooling end temperature fall within a temperature range of 250° C. or higher and 380° C. or lower. When the cooling end temperature is lower than 250° C., a structure consisting of ferrite and martensite is formed and a uniform structure cannot be obtained. Thus, cracking occurs at the time of processing and workability is deteriorated.

On the other hand, when the cooling end temperature exceeds 380° C., formed martensite is tempered and is decomposed into pearlite and thus, required strength cannot be obtained. Therefore, the cooling end temperature is set to a temperature in a temperature range of 250° C. or higher and 380° C. or lower. The cooling end temperature is preferably 280° C. or higher and 350° C. or lower.

Further, after the primary cooling, in a temperature range of 260° C. or higher and 370° C. or lower, retention (second retention) is performed for 180 seconds or longer and 540 seconds or shorter. After the primary cooling, by performing retention under the above conditions, it is possible to form a steel structure in which strength and elongation are more balanced (TS×El is high).

When the retention temperature is lower than 260° C., the area fraction of bainite and martensite is excessive and ductility is deteriorated. On the other hand, when the retention temperature exceeds 370° C., bainite and martensite are tempered and are decomposed into pearlite and thus, the retention temperature exceeding 370° C. is not preferable.

In addition, when the retention time is shorter than 180 seconds, C concentration on non-transformed austenite is not sufficiently promoted and pearlite is formed and, thus, a retention time shorter than 180 seconds is not preferable. On the other hand, when the retention time exceeds 540 seconds, productivity is deteriorated, and thus, a retention time exceeding 540 seconds is not preferable.

In the above retention, when the steel sheet according to the embodiment is subjected to microstructure control using a continuous annealing line, the steel sheet may be retained such that the temperature of an overaging section of the continuous annealing line is set to 260° C. or higher and 370° C. or lower and the steel sheet passes through the overaging section for 180 seconds or longer and 540 seconds or shorter.

After the second retention, the steel sheet may be cooled to room temperature using an arbitrary method to form a product.

Further, the inventors have found that when the steel sheet is retained in the overaging section, if y which is a product of retention temperature (overaging section passing temperature) and retention time (overaging section passing time) and x which is a primary cooling rate satisfy the following Expression, it is possible to further improve the balance between strength and elongation.

$$y \leq 796700 \times x^{(-0.971)}$$

FIG. 1 is a relationship between (overaging section passing temperature×overaging section passing time): y and primary cooling rate: x, which are examined by the inventors with actual machine.

It is possible to obtain a high strength steel sheet which has a low yield ratio and excellent elongation due to organic coordination of the soaking temperature, soaking time, primary cooling temperature, primary cooling stop temperature, retention temperature, and retention time in the steel sheet according to the embodiment.

The method of producing a steel sheet according to the embodiment can obtain the effect without limiting the apparatus, but from the viewpoint of promoting structure refinement by rapid heating and cooling and material homogenization in a coil, it is preferable to use the continuous annealing line.

In addition, in a case in which the continuous annealing line is used, when a steel sheet in which the primary cooling stop temperature of the steel sheet according to the embodiment (primary cooling outlet side sheet temperature) is set to 250° C. or higher and 380° C. or lower passes through the overaging section, it is preferable that a required amount of steel sheets in which the primary cooling stop temperature is set to 330° C. or lower (temperature adjusted steel sheet), for example, 30 tons or more of the steel sheets pass through the overaging section before the primary cooling starts in order to adjust the temperature of the overaging section to 260° C. or higher and 370° C. or lower. Accordingly, since equipment such as a blower for adjusting the temperature of the overaging section is not necessary, it is possible to reduce the size of the equipment and also, possible to reduce construction cost. Therefore, a steel sheet which has a low yield ratio, a tensile strength of 590 MPa or more, and excellent elongation can be easily obtained by the continuous annealing line.

When the temperature of the temperature adjusted steel sheet exceeds 330° C., the atmospheric temperature of the overaging section cannot be not sufficiently decreased, and thus, a temperature exceeding 330° C. is not preferable. Contrarily, when the temperature of the temperature adjusted steel sheet is lower than 300° C., the atmospheric temperature is excessively decreased, and thus, a temperature of lower than 300° C. is not preferable.

When 100 tons or more of steel sheets pass through the overaging section, the temperature of the overaging section is excessively decreased in some cases, and thus, it is preferable that the upper limit of the temperature adjusted steel sheet to pass be set to 100 tons. In addition, when a time from the pass of the temperature adjusted steel sheet is completed and to when the primary cooling starts exceeds 30 minutes, there is a concern that the above effect is hardly obtained and thus, it is preferable that the temperature adjusted steel sheet pass within 30 minutes before the primary coming starts.

EXAMPLES

Next, examples of the present invention will be described but the conditions in the examples are simply an example of conditions employed to confirm the feasibility and effect of the present invention, and the present invention is not limited to the example of conditions. The present invention can employ a variety of conditions within the scope of the present invention as long as the objective of the present invention can be achieved.

Example 1

Steel sheets having component compositions shown in Table 1 were subjected to heat treatment under the soaking conditions and retention conditions (overaging section passing conditions) shown in Table 2. The results are shown together in Table 2.

In the example, when the yield ratio was 65% or less, TS was 590 MPa or more, and TS×El was 17500 MPa·% or more, it is judged that the steel sheet was a high strength steel sheet which has a low yield ratio, and excellent elongation.

In the tensile test, a JIS 5 test piece was made by cutting each of the steel sheets in the perpendicular direction of the steel sheets to evaluate tensile strength according to JIS Z 2241:2011.

The observation and determination of the structure was performed in such a manner that samples etched using a nital reagent were observed at a magnification of 400 times at twenty visual fields with an optical microscope, and an area fraction of each structure was obtained by image analysis.

The remainder of the components in Table 1 refer to Fe and unavoidable impurities and "-" represents that there is nothing detected.

In the example of the present invention, it is possible to stably obtain the high strength steel sheets which have a low yield ratio, excellent elongation, and a tensile strength of 590 MPa or more.

TABLE 1

| STEEL TYPE | C | Si | Mn | P | S | Al | N | Cr | Mo | B | Nb | Ti | V | Ac1 (° C.) | Ac3 (° C.) |
|---|---|---|---|---|---|---|---|---|---|---|---|---|---|---|---|
| A | 0.081 | 0.45 | 2.10 | 0.007 | 0.0015 | 0.031 | 0.0021 | — | — | — | — | — | — | 714 | 873 |
| B | 0.077 | 0.43 | 2.10 | 0.008 | 0.0018 | 0.025 | 0.0018 | 0.15 | — | — | — | — | — | 718 | 872 |
| C | 0.083 | 0.48 | 1.95 | 0.009 | 0.0021 | 0.022 | 0.0022 | — | 0.05 | — | — | — | — | 716 | 876 |
| D | 0.078 | 0.46 | 2.20 | 0.006 | 0.0017 | 0.021 | 0.0017 | — | — | 0.0013 | — | — | — | 713 | 872 |
| E | 0.098 | 0.37 | 1.82 | 0.007 | 0.0016 | 0.033 | 0.0019 | — | — | — | 0.02 | — | — | 716 | 866 |
| F | 0.083 | 0.36 | 1.87 | 0.008 | 0.0029 | 0.019 | 0.0026 | — | — | — | — | 0.02 | — | 715 | 871 |
| G | 0.081 | 0.45 | 1.93 | 0.006 | 0.0017 | 0.031 | 0.0021 | — | — | — | 0.015 | — | 0.01 | 716 | 876 |
| H | 0.076 | 0.46 | 1.81 | 0.007 | 0.0015 | 0.023 | 0.0023 | 0.08 | — | — | 0.011 | 0.01 | — | 720 | 881 |
| I | 0.041 | 0.45 | 1.85 | 0.006 | 0.0017 | 0.031 | 0.0021 | — | — | — | — | — | — | 718 | 895 |
| J | 0.146 | 0.50 | 1.85 | 0.007 | 0.0015 | 0.025 | 0.0023 | — | — | — | — | — | — | 716 | 852 |
| K | 0.100 | 0.33 | 1.85 | 0.007 | 0.002 | 0.025 | 0.0026 | — | — | — | — | — | — | 714 | 862 |
| L | 0.100 | 0.62 | 1.85 | 0.007 | 0.002 | 0.025 | 0.0026 | — | — | — | — | — | — | 720 | 879 |
| M | 0.090 | 0.45 | 1.10 | 0.007 | 0.002 | 0.025 | 0.0017 | — | — | — | — | — | — | 726 | 888 |
| N | 0.090 | 0.45 | 2.90 | 0.007 | 0.002 | 0.025 | 0.0017 | — | — | — | — | — | — | 705 | 853 |
| O | 0.090 | 0.45 | 1.85 | 0.007 | 0.002 | 0.007 | 0.0024 | — | — | — | — | — | — | 717 | 874 |
| P | 0.090 | 0.45 | 1.85 | 0.007 | 0.002 | 0.080 | 0.0024 | — | — | — | — | — | — | 717 | 874 |
| Q | 0.090 | 0.45 | 1.85 | 0.026 | 0.002 | 0.025 | 0.0025 | — | — | — | — | — | — | 717 | 874 |
| R | 0.090 | 0.45 | 1.84 | 0.007 | 0.007 | 0.025 | 0.0025 | — | — | — | — | — | — | 717 | 874 |
| S | 0.090 | 0.45 | 1.84 | 0.007 | 0.002 | 0.025 | 0.0084 | — | — | — | — | — | — | 717 | 874 |
| a | 0.032 | 0.45 | 1.85 | 0.006 | 0.0017 | 0.031 | 0.0021 | — | — | — | — | — | — | 718 | 899 |
| b | 0.168 | 0.50 | 1.85 | 0.007 | 0.0015 | 0.025 | 0.0023 | — | — | — | — | — | — | 716 | 842 |
| c | 0.087 | 0.21 | 1.85 | 0.009 | 0.002 | 0.031 | 0.0016 | — | — | — | — | — | — | 713 | 861 |
| d | 0.087 | 0.82 | 1.87 | 0.01 | 0.0021 | 0.031 | 0.0016 | — | — | — | — | — | — | 723 | 895 |
| e | 0.087 | 0.45 | 0.94 | 0.007 | 0.0021 | 0.031 | 0.0015 | — | — | — | — | — | — | 728 | 893 |
| f | 0.087 | 0.45 | 3.40 | 0.007 | 0.004 | 0.031 | 0.0015 | — | — | — | — | — | — | 699 | 844 |
| g | 0.087 | 0.45 | 1.85 | 0.007 | 0.004 | 0.003 | 0.0017 | — | — | — | — | — | — | 717 | 875 |
| h | 0.087 | 0.45 | 2.50 | 0.007 | 0.004 | 0.031 | 0.0020 | 0.6 | — | — | — | — | — | 731 | 872 |

TABLE 2

| NO. | STEEL TYPE | Ac1 ° C. | Ac3 ° C. | SOAKING CONDITIONS: SOAKING TEMPERATURE ° C. | SOAKING CONDITIONS: SOAKING TIME sec | PRIMARY COOLING CONDITIONS: PRIMARY COOLING RATE ° C./sec | PRIMARY COOLING CONDITIONS: PRIMARY COOLING STOP TEMPERATURE ° C. | RETENTION CONDITIONS (OVERAGING SECTION): RETENTION TEMPERATURE ° C. | RETENTION CONDITIONS (OVERAGING SECTION): RETENTION TIME sec | RETENTION CONDITIONS (OVERAGING SECTION): RETENTION TEMPERATURE × RETENTION TIME ° C. · sec | RIGHT SIDE OF EXPRESSION (3) |
|---|---|---|---|---|---|---|---|---|---|---|---|
| 1 | A | 714 | 873 | 740 | 25 | 1 | 350 | 350 | 270 | 94500 | 796700 |
| 2 | A | 714 | 873 | 750 | 25 | 8 | 340 | 340 | 255 | 86700 | 105778 |
| 3 | A | 714 | 873 | 750 | 25 | 15 | 260 | 260 | 200 | 52000 | 57453 |
| 4 | A | 714 | 873 | 740 | 25 | 0.4 | 260 | 260 | 250 | 65000 | 1939521 |
| 5 | A | 714 | 873 | 780 | 25 | 35 | 340 | 340 | 260 | 88400 | 25235 |
| 6 | A | 714 | 873 | 740 | 17 | 12 | 260 | 260 | 255 | 66300 | 71353 |
| 7 | A | 714 | 873 | 740 | 13 | 12 | 260 | 260 | 255 | 66300 | 71353 |
| 8 | A | 714 | 873 | 750 | 25 | 12 | 240 | 240 | 255 | 61200 | 71353 |
| 9 | A | 714 | 873 | 760 | 25 | 12 | 400 | 400 | 120 | 48000 | 71353 |
| 10 | A | 714 | 873 | 730 | 35 | 12 | 330 | 330 | 180 | 59400 | 71353 |
| 11 | A | 714 | 873 | 880 | 17 | 12 | 260 | 260 | 255 | 66300 | 71353 |
| 12 | A | 714 | 873 | 740 | 17 | 12 | 380 | 380 | 60 | 22800 | 71353 |
| 13 | A | 714 | 873 | 740 | 17 | 4 | 260 | 260 | 500 | 130000 | 207345 |
| 14 | B | 718 | 872 | 740 | 17 | 12 | 260 | 260 | 255 | 66300 | 71353 |
| 15 | C | 716 | 876 | 830 | 17 | 12 | 260 | 260 | 255 | 66300 | 71353 |
| 16 | D | 713 | 872 | 740 | 17 | 12 | 260 | 260 | 255 | 66300 | 71353 |
| 17 | E | 716 | 870 | 820 | 17 | 12 | 260 | 260 | 255 | 66300 | 71353 |
| 18 | F | 715 | 871 | 800 | 17 | 12 | 260 | 260 | 255 | 66300 | 71353 |
| 19 | G | 716 | 876 | 789 | 17 | 12 | 260 | 260 | 255 | 66300 | 71353 |
| 20 | H | 720 | 881 | 740 | 17 | 12 | 260 | 260 | 255 | 66300 | 71353 |
| 21 | A | 714 | 873 | 740 | 17 | 0.03 | 270 | 260 | 400 | 104000 | 23988886 |
| 22 | A | 714 | 873 | 740 | 20 | 5 | 300 | 250 | 300 | 75000 | 166953 |
| 23 | A | 714 | 873 | 760 | 40 | 5 | 300 | 390 | 300 | 117000 | 166953 |
| 24 | I | 718 | 895 | 740 | 17 | 12 | 260 | 260 | 255 | 66300 | 71353 |
| 25 | J | 716 | 852 | 740 | 17 | 12 | 260 | 260 | 255 | 66300 | 71353 |
| 26 | K | 714 | 862 | 750 | 20 | 10 | 290 | 280 | 260 | 72800 | 85172 |
| 27 | L | 720 | 879 | 750 | 20 | 10 | 290 | 280 | 260 | 72800 | 85172 |
| 28 | M | 726 | 888 | 750 | 20 | 10 | 290 | 280 | 280 | 78400 | 85172 |
| 29 | N | 705 | 853 | 750 | 20 | 10 | 290 | 310 | 260 | 80600 | 85172 |
| 30 | O | 717 | 874 | 750 | 20 | 10 | 290 | 310 | 260 | 80600 | 85172 |
| 31 | P | 717 | 874 | 750 | 20 | 10 | 290 | 310 | 260 | 80600 | 85172 |
| 32 | Q | 717 | 874 | 750 | 20 | 10 | 290 | 310 | 280 | 86800 | 85172 |
| 33 | R | 717 | 874 | 750 | 20 | 10 | 290 | 310 | 260 | 80600 | 85172 |
| 34 | S | 717 | 874 | 750 | 20 | 10 | 290 | 310 | 260 | 80600 | 85172 |
| 35 | a | 718 | 899 | 750 | 20 | 10 | 290 | 310 | 260 | 80600 | 85172 |
| 36 | b | 716 | 842 | 750 | 20 | 10 | 290 | 310 | 260 | 80600 | 85172 |
| 37 | c | 713 | 861 | 750 | 20 | 10 | 290 | 310 | 260 | 80600 | 85172 |
| 38 | d | 723 | 895 | 750 | 20 | 10 | 290 | 310 | 260 | 80600 | 85172 |
| 39 | e | 728 | 893 | 750 | 20 | 10 | 290 | 310 | 260 | 80600 | 85172 |
| 40 | f | 699 | 844 | 750 | 20 | 10 | 290 | 310 | 260 | 80600 | 85172 |
| 41 | g | 717 | 875 | 750 | 20 | 10 | 290 | 310 | 260 | 80600 | 85172 |
| 42 | h | 731 | 872 | 750 | 20 | 10 | 290 | 310 | 260 | 80600 | 85172 |

| NO. | TENSILE STRENGTH MPa | YIELD STRENGTH MPa | ELONGATION % | YIELD RATIO (YR) % | TS × El MPa % | STRUCTURE: M + B % | STRUCTURE: RESIDUAL γ % | STRUCTURE: α % | STRUCTURE: P % | |
|---|---|---|---|---|---|---|---|---|---|---|
| 1 | 601 | 343 | 33 | 57 | 19833 | 6 | 3 | 91 | 0 | EXAMPLE |
| 2 | 622 | 348 | 32 | 56 | 19904 | 7 | 2 | 91 | 0 | EXAMPLE |
| 3 | 634 | 329 | 31 | 52 | 19654 | 8 | 2 | 90 | 0 | EXAMPLE |
| 4 | 584 | 399 | 33 | 68 | 19272 | 5 | 1 | 88 | 6 | COMPARATIVE EXAMPLE |
| 5 | 674 | 365 | 22 | 54 | 14828 | 12 | 0 | 88 | 0 | COMPARATIVE EXAMPLE |
| 6 | 612 | 354 | 31 | 58 | 18972 | 7 | 2 | 91 | 0 | EXAMPLE |
| 7 | 625 | 431 | 28 | 69 | 17500 | 8 | 0 | 86 | 6 | COMPARATIVE EXAMPLE |
| 8 | 653 | 382 | 23 | 58 | 15019 | 12 | 0 | 88 | 0 | COMPARATIVE EXAMPLE |
| 9 | 638 | 437 | 29 | 68 | 18502 | 8 | 0 | 88 | 4 | COMPARATIVE EXAMPLE |
| 10 | 609 | 354 | 33 | 58 | 20097 | 6 | 2 | 92 | 0 | EXAMPLE |
| 11 | 619 | 440 | 27 | 71 | 16713 | 8 | 0 | 88 | 4 | COMPARATIVE EXAMPLE |
| 12 | 618 | 422 | 28 | 68 | 17304 | 7 | 0 | 91 | 2 | COMPARATIVE EXAMPLE |
| 13 | 622 | 401 | 29 | 64 | 18038 | 6 | 2 | 92 | 0 | EXAMPLE |
| 14 | 611 | 354 | 33 | 58 | 20163 | 5 | 3 | 92 | 0 | EXAMPLE |
| 15 | 615 | 367 | 32 | 60 | 19680 | 5 | 2 | 93 | 0 | EXAMPLE |
| 16 | 626 | 375 | 31 | 60 | 19406 | 7 | 2 | 91 | 0 | EXAMPLE |
| 17 | 623 | 373 | 30 | 60 | 18690 | 7 | 1 | 92 | 0 | EXAMPLE |
| 18 | 618 | 366 | 31 | 59 | 19158 | 6 | 1 | 93 | 0 | EXAMPLE |
| 19 | 611 | 376 | 31 | 62 | 18941 | 6 | 2 | 92 | 0 | EXAMPLE |
| 20 | 608 | 387 | 30 | 64 | 18240 | 5 | 2 | 93 | 0 | EXAMPLE |
| 21 | 597 | 444 | 29 | 74 | 17313 | 6 | 0 | 90 | 4 | COMPARATIVE EXAMPLE |

TABLE 2-continued

| | | | | | | | | | | |
|---|---|---|---|---|---|---|---|---|---|---|
| 22 | 650 | 350 | 23 | 54 | 14950 | 12 | 0 | 88 | 0 | COMPARATIVE EXAMPLE |
| 23 | 579 | 421 | 27 | 73 | 15633 | 6 | 0 | 89 | 5 | COMPARATIVE EXAMPLE |
| 24 | 598 | 387 | 30 | 65 | 17940 | 5 | 2 | 93 | 0 | EXAMPLE |
| 25 | 698 | 387 | 28 | 55 | 19544 | 9 | 2 | 89 | 0 | EXAMPLE |
| 26 | 632 | 376 | 29 | 59 | 18328 | 8 | 2 | 90 | 0 | EXAMPLE |
| 27 | 618 | 399 | 30 | 65 | 18540 | 7 | 1 | 92 | 0 | EXAMPLE |
| 28 | 653 | 382 | 28 | 58 | 18284 | 10 | 2 | 88 | 0 | EXAMPLE |
| 29 | 614 | 379 | 30 | 62 | 18420 | 7 | 2 | 91 | 0 | EXAMPLE |
| 30 | 616 | 383 | 30 | 62 | 18480 | 6 | 2 | 92 | 0 | EXAMPLE |
| 31 | 621 | 371 | 29 | 60 | 18009 | 8 | 1 | 91 | 0 | EXAMPLE |
| 32 | 633 | 401 | 30 | 63 | 18990 | 9 | 3 | 88 | 0 | EXAMPLE |
| 33 | 609 | 389 | 31 | 64 | 18879 | 8 | 2 | 90 | 0 | EXAMPLE |
| 34 | 611 | 394 | 32 | 64 | 19552 | 7 | 1 | 92 | 0 | EXAMPLE |
| 35 | 564 | 392 | 31 | 70 | 17484 | 3 | 0 | 80 | 7 | COMPARATIVE EXAMPLE |
| 36 | 840 | 455 | 20 | 54 | 16800 | 15 | 1 | 84 | 0 | COMPARATIVE EXAMPLE |
| 37 | 588 | 399 | 34 | 68 | 19992 | 6 | 1 | 90 | 3 | COMPARATIVE EXAMPLE |
| 38 | 630 | 444 | 35 | 70 | 22050 | 7 | 6 | 87 | 0 | COMPARATIVE EXAMPLE |
| 39 | 543 | 411 | 33 | 76 | 17919 | 4 | 0 | 84 | 12 | COMPARATIVE EXAMPLE |
| 40 | 850 | 460 | 19 | 54 | 16150 | 16 | 0 | 84 | 0 | COMPARATIVE EXAMPLE |
| 41 | 621 | 432 | 28 | 70 | 17388 | 8 | 0 | 88 | 4 | COMPARATIVE EXAMPLE |
| 42 | 840 | 473 | 19 | 56 | 15960 | 17 | 2 | 81 | 0 | COMPARATIVE EXAMPLE |

Underlines indicate that the values were outside the range of the present invention.
Structure α: Ferrite M: Martensite Residual γ: Residual austenite B: Bainite P: Pearlite

Example 2

Before the steel sheet of steel type A in Table 1 passed through the overaging section of the continuous annealing line after primary cooling, a temperature adjusted steel sheet passed though the continuous annealing line under the conditions shown in Table 3. Then, the steel sheet of steel type A in Table 4 passed the overaging section. The results are shown in Table 5. The temperature control of the overaging section was not performed except during the passage of the steel sheet. It was found that the temperature of the overaging section could be decreased in an appropriate range by allowing the temperature adjusted steel sheet to pass through the overaging section of the continuous annealing line in advance, and the steel sheet of the present invention could be obtained without cooling by a blower and the like.

TABLE 3

| No. | PRIMARY COOLING STOP TEMPERATURE ° C. | NUMBER OF TONS OF PASSING ton | OVERAGING SECTION TEMPERATURE ° C. | OVERAGING SECTION PASSING TIME sec |
|---|---|---|---|---|
| 43 | 300 | 32 | 310 | 255 |
| 44 | 320 | 40 | 320 | 255 |
| 45 | 320 | 28 | 375 | 255 |
| 46 | 340 | 100 | 375 | 255 |

TABLE 4

| COMPONENT | Ac1 ° C. | Ac3 ° C. | SOAKING TEMPERATURE ° C. | SOAKING TIME sec | PRIMARY COOLING RATE ° C./sec | PRIMARY COOLING STOP TEMPERATURE ° C. |
|---|---|---|---|---|---|---|
| A | 714 | 872 | 740 | 17 | 12 | 260 |

TABLE 5

| No | TENSILE STRENGTH MPa | YIELD STRENGTH MPa | ELONGATION % | YR % | TS × El MPa · % | STRUCTURE M + B (MARTENSITE + BAINITE) % | RESIDUAL γ: RESIDUAL AUSTENITE % | α ferrite % | P pearlite % | |
|---|---|---|---|---|---|---|---|---|---|---|
| 43 | 611 | 342 | 32 | 56 | 19552 | 7 | 2 | 91 | 0 | EXAMPLE |
| 44 | 606 | 330 | 33 | 54 | 19998 | 7 | 2 | 91 | 0 | EXAMPLE |
| 45 | 615 | 434 | 28 | 71 | 17220 | 5 | 0 | 88 | 7 | COMPARATIVE EXAMPLE |
| 46 | 622 | 444 | 27 | 71 | 16794 | 5 | 0 | 88 | 7 | COMPARATIVE EXAMPLE |

INDUSTRIAL APPLICABILITY

As described above, according to the present invention, it is possible to provide the high strength steel sheet which is suitable for vehicle bodies and parts for automobiles and has a low yield ratio and excellent elongation. Therefore, the present invention has high industrial applicability in the steel industry and the automobile manufacturing industry.

The invention claimed is:

1. A steel sheet comprising, by mass %,
C: 0.04% or more and 0.15% or less,
Si: 0.3% or more and 0.7% or less,
Mn: 1.0% or more and 3.0% or less,
Al: 0.005% or more and 0.10% or less,
P: limited to 0.03% or less,
S: limited to 0.01% or less,
N: limited to 0.01% or less, and
a remainder Fe and unavoidable impurities,
wherein the steel sheet has a steel structure obtained by performing a soaking for a soaking time of 15 seconds or longer and 35 seconds or shorter at a dual phase region temperature of Ac1 temperature or higher and lower than Ac3 temperature, next, performing a primary cooling to a temperature range of 250° C. or higher and 380° C. or less at a cooling rate of 0.5° C./s or more and 30° C./s or less within 3 seconds, and performing a retention in a temperature range of 260° C. or higher and 370° C. or lower for 180 seconds or longer and 540 seconds or shorter after the primary cooling,
the steel structure contains, by an area fraction, a total fraction of bainite and martensite of 5% or more and 9% or less, a residual austenite of 1% or more and 3% or less, and a remainder consisting of a ferrite,
a yield ratio is 55% or more and 65% or less and tensile strength is 590 MPa or more, and
the Ac1 temperature is a temperature expressed by a following Expression (1) in units of ° C., and the Ac3 temperature is a temperature expressed by a following Expression (2) in units of ° C., $$Ac1=732-26.6\times[C]+17.6\times[Si]-11.6\times[Mn] \quad (1),$$

$$Ac3=924+56.1\times[Si]-19.7\times[Mn]-436.5\times[C] \quad (2),$$

here, [C], [Si], and [Mn] represent a C content, an Si content, and an Mn content respectively, and a unit thereof is mass %.

2. The steel sheet according to claim 1,
wherein in the steel structure, by an area fraction, the bainite that is limited to 1% or less.

3. The steel sheet according to claim 1, further comprising, by mass %,
one or two or more of Nb, Ti, and V of 0.005% or more and 0.05% or less in total.

4. The steel sheet according to claim 1, further comprising, by mass %, any one or two or more of
Cr: 0.01% or more and 0.5% or less,
Mo: 0.01% or more and 0.5% or less, and
B: 0.0005% or more and 0.005% or less,
wherein the Ac1 temperature is a temperature expressed by a following Expression (4) in units of ° C., and the Ac3 temperature is a temperature expressed by a following Expression (5) in units of ° C., $$Ac1=732-26.6\times[C]+17.6\times[Si]-11.6\times[Mn]+24.1\times[Cr] \quad (4),$$

$$Ac3=924+56.1\times[Si]-19.7\times[Mn]-4.9\times[Cr]-436.5\times[C] \quad (5),$$

here, [C], [Si], [Mn], and [Cr] represent a C content, an Si content, an Mn content, and a Cr content respectively, and a unit thereof is mass %.

5. The steel sheet according to claim 4, further comprising, by mass %,
one or two or more of Nb, Ti, and V of 0.005% or more and 0.05% or less in total.

6. The steel sheet according to claim 1,
wherein y which is a product of a retention temperature and a retention time in the retention and x which is the cooling rate in the primary cooling satisfy a following Expression (3), $$y\leq 796700\times x^{(-0.971)} \quad (3).$$

7. The steel sheet according to claim 6, further comprising, by mass %, any one or two or more of
Cr: 0.01% or more and 0.5% or less,
Mo: 0.01% or more and 0.5% or less, and
B: 0.0005% or more and 0.005% or less,
wherein the Ac1 temperature is a temperature expressed by a following Expression (4) in units of ° C., and the Ac3 temperature is a temperature expressed by a following Expression (5) in units of ° C., $$Ac1=732-26.6\times[C]+17.6\times[Si]-11.6\times[Mn]+24.1\times[Cr] \quad (4),$$

$$Ac3=924+56.1\times[Si]-19.7\times[Mn]-4.9\times[Cr]-436.5\times[C] \quad (5),$$

here, [C], [Si], [Mn], and [Cr] represent a C content, an Si content, an Mn content, and a Cr content respectively, and a unit thereof is mass %.

8. The steel sheet according to claim 6, further comprising, by mass %,
one or two or more of Nb, Ti, and V of 0.005% or more and 0.05% or less in total.

9. The steel sheet according to claim 1,
wherein the cooling rate is 0.5° C./s or more and 15° C./s or less.

10. The steel sheet according to claim 9, further comprising, by mass %, any one or two or more of
Cr: 0.01% or more and 0.5% or less,
Mo: 0.01% or more and 0.5% or less, and
B: 0.0005% or more and 0.005% or less,
wherein the Ac1 temperature is a temperature expressed by a following Expression (4) in units of ° C., and the Ac3 temperature is a temperature expressed by a following Expression (5) in units of ° C., $$Ac1=732-26.6\times[C]+17.6\times[Si]-11.6\times[Mn]+24.1\times[Cr] \quad (4),$$

$$Ac3=924+56.1\times[Si]-19.7\times[Mn]-4.9\times[Cr]-436.5\times[C] \quad (5),$$

here, [C], [Si], [Mn], and [Cr] represent a C content, an Si content, an Mn content, and a Cr content respectively, and a unit thereof is mass %.

11. The steel sheet according to claim 9, further comprising, by mass %,
one or two or more of Nb, Ti, and V of 0.005% or more and 0.05% or less in total.

* * * * *